United States Patent [19]

Bastone

[11] Patent Number: 4,658,616

[45] Date of Patent: Apr. 21, 1987

[54] AUTOMATIC ROLLER SWAGE MACHINE

[75] Inventor: Robert P. Bastone, Thousand Oaks, Calif.

[73] Assignee: Sierracin Corporation, Sylmar, Calif.

[21] Appl. No.: 661,098

[22] Filed: Oct. 15, 1984

[51] Int. Cl.[4] ..... B21D 39/10

[52] U.S. Cl. ..... 72/19; 72/30; 72/122; 72/443; 318/434

[58] Field of Search ..... 29/727, 157.3 C; 318/434; 173/5, 6, 12; 72/19, 30, 122, 123, 125, 443

[56] References Cited

U.S. PATENT DOCUMENTS

| | | | |
|---|---|---|---|
| 3,031,008 | 4/1962 | Schmidt . | |
| 3,585,701 | 6/1971 | Stary . | |
| 3,628,227 | 12/1971 | Blackburn et al. . | |
| 4,066,942 | 1/1978 | Bardwell et al. | 318/434 |
| 4,147,385 | 4/1979 | Velden . | |
| 4,215,594 | 8/1980 | Workman, Jr. et al. | 173/12 |
| 4,239,713 | 12/1980 | Brif et al. | 264/40.1 |

FOREIGN PATENT DOCUMENTS

| | | | |
|---|---|---|---|
| 2506326 | 8/1976 | Fed. Rep. of Germany | 72/122 |

OTHER PUBLICATIONS

Handbook for the type 2,000 MK 2A Swaging Machine (dated 11—81), Lancashire, England pp. 1, 2, 5, 8, 15, 18, 19.

Boeing Document No. D6—48861, pp. 1, 4, 5, 7, 8, 9, 11, Dec. 21, 1981.

*Primary Examiner*—Lowell A. Larson

*Attorney, Agent, or Firm*—Sheldon & Mak

[57] ABSTRACT

A machine and method for roller swaging hydraulic fitting sleeves onto metallic tubing comprises a tapered roller mandrel expander driven at a first high speed for rapidly expanding the tubing and at a second low speed until the drive torque reaches a final preselected value for preventing springback of the tubing and accurately controlling the amount of swaging. A torque transducer monitors mandrel loading for automatic control of machine operations. The machine provides an automatic swaging cycle inserting the expander, engaging the tapered mandrel, rotating the mandrel at the high and low speeds, reversing rotation of the mandrel for disengagement of the expander, and withdrawing the mandrel and the expander. Tare torque is measured in each swaging cycle, compensating for changing mandrel bearing drag, etc.

13 Claims, 7 Drawing Figures

EX
P
AUX

EXHAUST
'CLAMP'
'SWAGE'
POWER
PRESSURE
ADC
DAC
VCO
CTR
INPUT OUTPUT INTERFACE
PROGRAM MEMORY
DATA MEMORY
MICRO-PROCESSOR
LOW
REV
HIGH
FIN
INT
ENG.
TARE
FREE
OFF
ON
TR
N
V2
V3
V4

AUTOMATIC ROLLER SWAGE MACHINE

BACKGROUND

This invention relates to roller swaging of tubing, such as for attaching hydraulic fitting sleeves to high strength, thin wall, aerospace hydraulic tubing.

Roller swaging of tubing for attachment of hydraulic fittings is a common practice in the aerospace industry. In roller swaging, the end of an expander assembly is inserted into the tube to be swaged. At the time of insertion, a sleeve to be swaged onto the tube is loosely in place on the tube. The end of the expander assembly includes a plurality of rollers that are free to move radially toward and away from the longitudinal axis of the expander assembly. A rotating tapered mandrel is moved along the axis of the expander assembly, frictionally engaging the rollers and forcing the rollers against the inner wall of the tube. The mandrel continues to rotate and advance, causing the rollers to expand the tube, forcing tube material to flow into grooves in the sleeve, effecting a strong sealed connection between the tube and the sleeve.

Roller swaging operations in the prior art exhibit one or more of the following disadvantages:

1. Poor control of the amount of swaging. Insufficient swaging can cause failure of the joint between the tube and the sleeve; too much swaging can cause the tube to crack. Either condition can result in leakage of an installed fitting. When titanium tubing is used, especially tight control of the amount of swaging is required to obtain acceptable quality.

2. Short tool life. Rapid wear of the swaging rollers is experienced after swaging progresses beyond a desired amount. This disadvantage is related to control of the amount of swaging, discussed above. Undesireable wear also occurs when there is axially sliding contact between the rollers and the mandrel during swaging. Most roller swaging machines of the prior art now provide a slightly skewed roller orientation producing self-feeding of the tapered mandrel without axial sliding against the rollers. However, some roller swaging machines continue rotation of the mandrel after preventing further advancement at the end of swaging. This produces axially sliding contact between the rollers and the mandrel when swaging forces are greatest, producing rapid wear of the rollers and the tapered mandrel.

3. Low speed operation. Manual adjustments and operations are time consuming and therefore expensive. When titanium tubing is used, a slow rate of swaging is required to prevent the tubing from springing back to a smaller diameter following completion of the swage, which can result in failure of the joint.

One method of roller swaging used in the past was to swage the tube to a selected inner diameter by inserting the rotating tapered mandrel a selected distance into the expander assembly. By advancing the mandrel a selected distance into the expander, the rollers are moved outwardly to a known diameter, which in this case is the selected inner tube diameter. It has been found, however, that when swages are made to a selected inner tube diameter, the strength of the swaged connection is not as consistent as desired. This lack of consistency is due to variations in tube wall thickness and diameter, and to a lesser extent, sleeve wall thickness and diameter.

Another method of roller swaging used in the past is to base completion of the swage on a selected torque value required to turn the expander assembly. Using torque as a basis for determining when the swage is complete has been found to provide more uniformly strong swaged joints than are provided when such swaging is based on a selected inner tube diameter.

Devices used in the prior art for terminating roller swaging at a selcted torque value exhibit one or more of the following disadvantages:

1. Individual, interchangeable, pre-set torque limiters are awkward to exchange and store, and impractical to adjust;

2. Torque sensing by measurement of electrical current in a mandrel drive motor can be inaccurate;

3. Torque limiting based on balancing a gimballed motor housing against an adjustable bias such as a spring requires time-consuming manual adjustment of the bias to effect a change in the limiting torque;

4. Torque limiting by manual use of a torque wrench driving the mandrel is too slow for economical production and subject to operator-induced variation; and 5. Non-uniform swaging results from failure to compensate for the torque required to turn the mandrel before swaging actually begins.

Thus there is a need for a roller swaging machine which closely controls the amount of swaging, has long tool life, swages at high speed, is easy to use, and is automatic in operation.

SUMMARY

Accordingly the automatic roller swage machine of the present invention closely controls the amount of swaging, has long tool life, swages at high speed in an automatic swaging cycle, and is easy to use.

The machine includes a roller expander having a tapered mandrel which is rotated and advanced to expand the tube into engagement with a fitting sleeve, and a motor drive rotating the mandrel at high speed and low speeds, and means controlling the drive for rotating the mandrel at the high speed during initial expansion of the tube and at low speed of no more than 50 percent of the high speed during final expansion of the tube when rotation of the mandrel requires more than 90 percent of a final maximum torque. The high and low speed rotation of the mandrel provides the advantages of rapid swaging and an absence of spring back following the conclusion of the swaging operation.

Preferably the drive has a torque transducer for measuring the torque required to rotate the mandrel during swaging. When the measured torque reaches a predetermined final value, rotation of the mandrel is reversed, ending the swaging operation.

The torque transducer, taking the place of awkward individual torque limiters, time-consuming manual-operations and adjustments, and inaccurate sensing of motor current levels, continuously provides for monitoring of mandrel torque while swaging a variety of tube and sleeve combinations. The measurements by the torque transducer can be compared with one or more references corresponding to each of the tube and sleeve combinations.

Preferably the torque transducer is provided with zeroing means compensating for the torque required to turn the mandrel before the initial expansion of the tube. The compensation of the torque transducer is preferably repeated at the beginning of each swaging cycle to provide a precisely uniform amount of swaging for improved uniformity in the swaged connections. An additional advantage is that a more uniformly high proportion of swaging can be done at high speed without spring back.

The high speed drive of the mandrel can be terminated, commencing the low speed drive, after a predetermined advance of the mandrel with corresponding expansion of the tube. Preferably the high speed drive is terminated after a predetermined intermediate drive torque level is reached, a torque level at least forty percent of that required to complete the swage for avoiding a need to measure the advance of the mandrel. Preferably the intermediate drive torque level is at least approximately 80 percent of that required to complete the swage.

Preferably, the machine is provided with an automatic swaging cycle initiated by the operator following clamping of the die, the machine automatically:

(a) inserting the expander;
(b) rapidly rotating and advancing the mandrel until the rollers engage the tube;
(c) continuing the rapid rotation until a predetermined first torque level is reached;
(d) slowly rotating the mandrel at no more than half of the speed of rapid rotation until a predetermined final torque level is reached;
(e) reversing rotation of the mandrel for releasing the expander; and
(f) retracting the mandrel and the expander.

Thus an automatic roller swaging machine is provided which closely controls the amount of swaging, has long tool life, swages at high speed, and is easy to use.

DRAWINGS

These and other features, aspects, and advantages of the present invention will become better understood with reference to the following description, appended claims, and accompanying drawings where:

DESCRIPTION

Figures 1, 5:
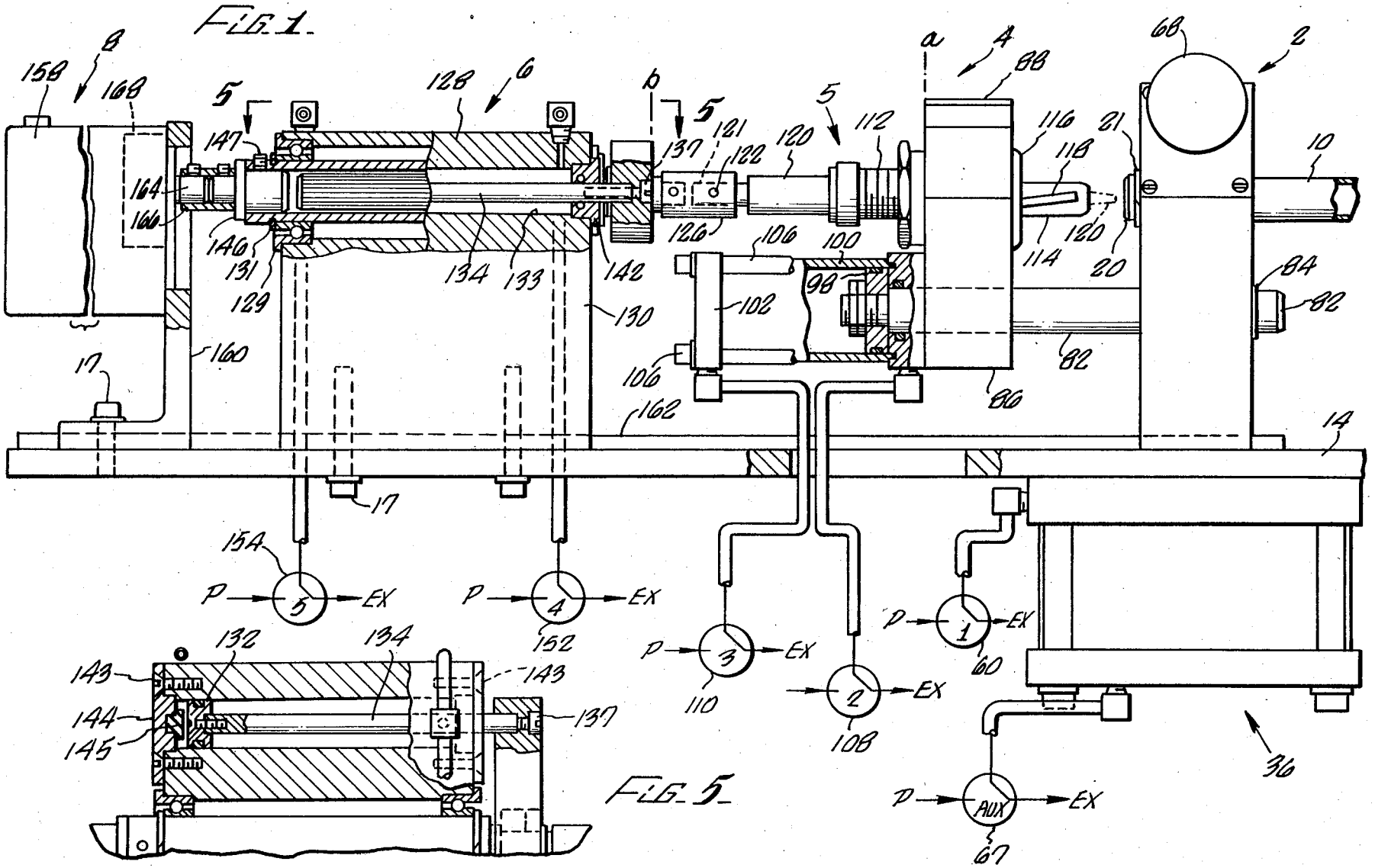
FIG. 1 is a fragmentary side elevational view of a roller swaging machine according to the present invention, the machine incorporating a roller expander assembly shown in a disengaged position.
FIG. 5 is a fragmentary sectional plan view of the machine of FIG. 1 taken along 5—5 in FIG. 1.

This invention is directed to an automatic roller swaging apparatus and method for attaching hydraulic fittings to metallic tubing. The swaging is performed at high speed until nearly complete, then at low speed to prevent harmful springback of high strength tubing material such as titanium. A machine for swaging according to the present invention comprises a vise unit 2 for clamping workpiece elements, a tool unit 4 movably mounted thereon for axially positioning on expander tool 5, a spline unit 6 rotationally coupling and axially engaging the expander tool 5, a motor unit 8 for rotationally driving the spline unit 6, the machine preferably being connected in a computer system 9 for automatic control of a swaging cycle.

Vise Unit 2

With reference to FIGS. 1–5, a tube 10, with a sleeve 11 in place thereon, are the workpiece elements clamped in the vise unit 2. The vise unit 2 is mounted on a base 14, which is supported at a convenient height by a suitable frame, not shown.

The vise unit 2 includes a stationary jaw 16, attached to the base 14 by a plurality of screws 17. A movable jaw 18 is pivotably attached to the stationary jaw 16 by a hinge pin 20, the hinge pin 20 being parallel to and laterally displaced from the tube 10. The hinge pin 20 is held in place by a retaining ring 21 on each end thereof. The stationary jaw 16 and the movable jaw 18 are each adapted to receive interchangeable sets of dies for clamping various sizes of the tube 10 and the sleeve 11. Each set of dies includes a die ring 22, a lower die shell 24, and an upper die shell 26. The lower die shell 24 is clamped within the stationary jaw 16 by means of a pair of die screws 28. The upper die shell 26 is retained in the movable jaw 18 by a pair of oppositely disposed die spring plungers 30. The die ring 22 is provided with a cavity 32, closely fitting one end of the sleeve 11. The cavity 32 includes a shoulder 33 to facilitate positioning the tube 10 flush with the sleeve 11.

The die ring 22 and that portion of the sleeve 11 not within the cavity 32 are rigidly clamped by closely fitting portions of the lower die shell 24 and the upper die shell 26. The die ring 22, the lower die shell 24, and the upper die shell 26 combine to prevent expansion of the sleeve 11 during swaging of the tube 10. The die ring 22, confining a critical portion of the sleeve 11 within the cavity 32, has no parting line within the critical region so that no pressure ridges are produced on the sleeve 11 in that region during swaging. Such pressure ridges would othewise impair proper sealing of the sleeve 11 to a fitting in use. Pressure ridges developed during swaging at parting lines between the die ring 22, the lower die shell 24, and the upper die shell 26 are not detrimental to proper functioning of the sleeve 11.

A pair of resilient ring members 34, surrounding the tube 10, are retained by the lower die shell 24 and the upper die shell 26. The ring members 34 resiliently clamp the tube 10 so that once positioned against the shoulder 34 of the die ring 22, the tube 10 is held in position prior to, and prevented from rotating during swaging.

The movable jaw 18 is held tightly closed against the stationary jaw 16 during swaging by a clamp actuator 36. The clamp actuator 36 includes a clamp shaft 38 which is slidably and rotatably located perpendicular to the hinge pin 20 and displaced oppositely from the tube 10 with respect to the hinge pin 20. The clamp shaft 38 has a dog 40 for engaging a dog seat 42 in the movable jaw 18. The clamp shaft 38 passes through a dog slot 44 in the movable jaw so that the dog 40 can be selectively engaged and disengaged from the dog seat 42 by rotation of the clamp shaft 38.

A pair of slot cams 46 are provided on opposite sides of the clamp shaft 38, each slot cam 46 engaging a corresponding cam pin 48 resiliently mounted in the stationary jaw 16. Each cam pin 48 can be a commercially available threaded spring-plunger.

Each of the slot cams 46 is configured to rotate the clamp shaft 38 from an engaged position when the dog is holding the movable jaw 18 against the stationary jaw 16, and, when the clamp shaft 38 is axially displaced to release a clamping force, rotated so that the dog 40 can pass through the dog slot 44. The rotation of the clamp shaft 38 thus permits the movable jaw 18 to be opened completely clear of the clamp shaft 38, facilitating loading and unloading of the tube 10 and the sleeve 11, and exchanging die sets.

Axial movement of the clamp shaft 38 is accomplished by a clamp piston 50 operating in a clamp cylinder 52, the clamp cylinder 52 being sealingly clamped between a clamp cylinder block 54 and a clamp cylinder head 56 by a plurality of clamp cylinder screws 58. The clamp cylinder screws 58 can be threaded into the base 14 for securing the clamp cylinder block to the underside of the base 14. A first solenoid valve 60 is hydraulically connected through the clamp cylinder block 54 for selectively pressurizing and exhausting a volume within the clamp cylinder 52 above the clamp piston 50. A shoulder ring 62 is fixed to the bottom of the clamp shaft 38 for axial operation of the clamp shaft 38. A compression spring 64, located between the shoulder ring 62 and the clamp cylinder head 56, biases the clamp shaft 38 upwardly against hydraulic pressure above the clamp piston 50. A pair of thrust bearings 66 is provided in the clamp actuator 36 to facilitate free rotation of the clamp shaft 38 corresponding to axial movement of the clamp shaft 38. The thrust washers 66 are located between the compression spring 64 and the clamp cylinder head 66, and between the clamp piston 50 and the shoulder ring 62.

The compression spring 64 lifts the clamp shaft 38 when the first solenoid value 60 is deenergised or when hydraulic pressure is not available. This insures that the vise unit 2 may be opened when power is removed from the machine.

Preferably an auxiliary solenoid valve 67 is hydraulically connected through the clamp cylinder head 56 for selectively pressuring and exhausting a volume within the clamp cylinder 52 below the clamp piston 50.

When the first solenoid valve 60 is unenergized (and the auxiliary solenoid valve 67 is energized), hydraulic pressure above the clamp piston 50 is exhausted, permitting the compression spring 64 (and hydraulic pressure below the clamp piston 50) to lift the clamp shaft 38, lifting the dog 40 from the dog seat 42 and rotating the dog 40 into alignment with the dog slot 44. The hydraulic pressure below the clamp piston 50 causes the clamp shaft 38 to be lifted more rapidly than if it were raised by the compression spring 64 alone. A jaw handle 68, attached to the movable jaw 18, can then be used to open the movable jaw 18 clear of the dog 40. A slot cover 70, attached to the movable jaw 18 by cover screws 71, shields the fingers of an operator from inadvertent contact with the dog 40. The movable jaw 18 is provided with a jaw detent 72, engaging a detent spring plunger 74 for holding the movable jaw 18 in an open position. The movable jaw 18 can also be provided with a thumb screw 76 for assisting in removing the upper die shell 26 when use of a different die set is desired.

When the tube 10, the sleeve 11, and the die ring are in place in the lower die shell 24, the operator closes the moveable jaw 18 while holding the tube 10 against the shoulder 33 of the cavity 32. The first solenoid valve 60 may then be energized (the auxiliary solenoid valve 67 unenergized), lowering the clamp piston 50 and the clamp shaft 38, rotating and lowering the dog 40 into engagement with the dog seat 42, clamping the tube 10 and the sleeve 11 between the lower die shell 24 and the upper die shell 26.

Preferably an interlock switch 78 fastened to the stationary jaw 16 by a pair of switch screws 79 is actuated when the movable jaw 18 is closed against the stationary jaw 16. The interlock switch 78 can be electronically connected to prevent the first solenoid valve 60 from becoming energized unless the movable jaw 18 is closed.

Tool Unit 4

The tool unit 4 is slidably located on a pair of guide rods 82, the guide rods 82 being fixably mounted to the stationary jaw 16 of the vise unit 2. The guide rods 82 are parallel with the tube 10 and axially located with respect to the stationary jaw 16 by a pair of retainer rings 84. The tool unit 4 includes a tool block 86 guided by the guide rods 82 and having a removable tool cap 88, the tool block 86 and the tool cap 88 enclosing and locating the expander tool 5, described below, in axial alignment with the tube 10.

A pair of guide bearings 92, installed on opposite sides of the tool block 86, locates the tool block 86 on each of the guide rods 82. The tool cap 88 is provided with a pair of dowel pins 94, fixably mounted thereto, for slidably engaging the tool block 86 to locate the tool cap 88 on the tool block 86, for convenient removal of the tool cap 88 from the tool unit 4. A dowel spring plunger 96 can be mounted in the tool block 86, engaging the dowel pin 94, for holding tool cap 88 against the tool block 86 to prevent misalignment of the expander tool 5.

A tool piston 98 is fixedly attached to each die rod 82 for hydraulic actuation of the tool unit 4, axially positioning the expander tool 5 with respect to the tube 10. Each tool piston 98 slidably engages a tool cylinder 100, each tool cylinder 100 being sealingly clamped between a respective tool cylinder head 102 and a tool cylinder block 104 by a plurality of tool cylinder screws 106. The tool cylinder screws 106 can be threaded into the tool block 86 for fixing each tool cylinder block 104 against the tool block 86. A second solenoid valve 108 is hydraulically connected to the tool cylinder block 104 for selectively pressurizing and exhausting the tool cylinder 100 between the tool piston 98 and the tool cylinder block 104. When hydraulic pressure is applied by the second solenoid valve 108, the tool unit 4 is caused to move toward the vice unit 12, advancing the expander tool 5 into the tube 10.

A third solenoid valve 110 is hydraulically connected to the tool cylinder head 102 for selectively pressurizing and exhausting the tool cylinder 100 between the tool cylinder head 102 and the tool piston 98. When hydraulic pressure is applied by means of the third solenoid valve 110, the tool unit 4 is caused to move away from the vise unit 2, withdrawing the expander tool 5 from the tube 10.

The second solenoid valve 108 can be operated in conjunction with the third solenoid valve 110 as a four-way solenoid valve, as described in more detail below. Similarly, the first solenoid valve 60 can be operated in conjunction with the auxiliary solenoid valve 67 as another four-way solenoid valve. Thus, operation of the first solenoid valve 60 and the second solenoid valve 108 impliedly includes opposite operation of the auxiliary solenoid valve 67 and the third solenoid valve 110, respectively.

Expander Tool 5

The expander tool 5 is an adaptation of a similar expander tool that was earlier developed for manual use in a repair depot. A cylindrical expander body 112, having a nose portion 114 is rotatably mounted in a journal housing 116, the nose portion 114 having an outside diameter slightly smaller than the inside diameter of the tube 10. The journal housing 116 is adapted to be retained between the tool block 86 and the tool cap 88, removable for easily exchanging the expander tool 5. A plurality of tapered rollers 118 is retained by the nose portion 114, the tapered rollers 118 being free to travel outwardly beyond the circumference of the nose portion 114. A tapered mandrel 120, centered within the expander body 112, engages the tapered rollers 118, forcing the tapered rollers 118 outwardly in response to axial movement of the tapered mandrel 120. The tapered rollers 118 and the tapered mandrel 120 have complimentary tapers, the tapered rollers 118 inscribing a cylindrical surface when engaged with the tapered mandrel 120. The tapered rollers 118 are aligned by the nose portion 114 in a slightly skewed configuration with respect to the nose portion 114, so that rotation of the tapered mandrel 120, while engaging the tapered rollers 118 against the inside diameter of the tube 10, results in axial advancement of the tapered mandrel 120 and progressive enlargement of the tube 10 by the tapered rollers 118. Conversely, opposite rotation of the tapered mandrel 120 releases the tapered mandrel 120 from the tapered rollers 118, facilitating withdrawal of the expander tool 5 from the tube 10 following completion of a swaging operation.

Preferably the tapered mandrel 120 has, opposite to the journal housing 116, a square drive member 121 for external drive. Preferably the drive member 121 is equipped with a spring-loaded coupling pin 122, for facilitating exchange of the expander tool 5.

Spline Unit 6

The tapered mandrel 120 is both rotated and positioned axially by a spline unit 6. A spline shaft 124 is fixedly connected to the drive member 121 of the tapered mandrel 120 by a drive coupling 126, the drive coupling engaging the coupling pin 122. The spline shaft 124 slidably engages a spindle shaft 128, the spindle shaft 128 being rotatably mounted on a pair of spindle bearings 129 in a spindle housing 130 in axial alignment with the tube 10. The spindle shaft 128 and the spindle bearings 129 are located within the spindle housing 130 by a pair of spindle retainers 131.

Two spindle pistons 132, guided within corresponding spindle cylinders 133 on opposite sides of the spindle shaft 128, are connected to provide axial movement of the spline shaft 124 within the spindle shaft 128, as further described herein.

Each spindle piston 132 is affixed at one end of a corresponding spindle rod 134 by a spindle screw 135, the opposite end of each spindle rod being fastened to a spline yoke 136 by a corresponding yoke screw 137. The spline shaft 124 protudes through the spline yoke 136 and is rotationally coupled thereto by a yoke bearing 138. The yoke bearing 138 is held within the spindle yoke 136 by a yoke retainer 139. The yoke bearing 138 is held in place on the spindle shaft 124 by a bearing spacer 140 and a bearing retainer 141. Thus axial movement of the spindle pistons 132 in the spindle cylinder 134 produces a corresponding movement of the spline shaft 124.

The spindle cylinders 133 are each sealed at the ends thereof for the application of hydraulic pressure to opposite sides of the spindle pistons 132. A rod flange 142, sealingly engaging a corresponding spindle rod 134, is fastened to the spindle housing 130 by flange screws 143. A cylinder flange 144, fastened by additional flange screws 143, sealingly covers the opposite ends of the spindle cylinders 133. Axial movement of the spindle pistons 132 within the spindle cylinders 133 produces a corresponding axial movement of the tapered mandrel 120.

A fourth solenoid valve 152 is hydraulically connected to the spindle housing 130 for selectively pressurizing and exhausting the spindle cylinders 133 between the spindle pistons 132 and the rod flange 142. Hydraulic pressure introduced by operation of the fourth solenoid valve 152 biases the spindle pistons 132 in a direction tending to withdraw the tapered mandrel 120 from engagement with the tapered rollers 118. A fifth solenoid valve 154 is hydraulically connected to the spindle 130 for selecting pressurizing and exhausting the spindle cylinders 133 between the spindle pistons 132 and cylinder flange 144. Thus hydraulic pressure from the fifth solenoid valve 154 biases the spindle pistons 132 in a direction tending to advance the tapered mandrel 120 into engagement with the tapered rollers 118 for initiating the swaging of the tube 10.

The spindle shaft 128 is provided with a spindle extension 146 opposite the drive coupling 126 for coupling to the motor unit 8. The spindle extension 146 can be fastened to the spindle shaft 128 by a set screw 147.

Motor Unit 8

A motor unit 8 is connected to the spline unit 122 for rotation of the tapered mandrel 120. The motor unit 8 includes a motor 158 attached to a motor mount 160 in axial alignment with the tube 10. The motor mount 160 is fastened to the base 14 by the mount screws 17. The lower die shell 24, the spindle housing 130, and the motor mount 160 are each adapted to engage an alignment bar 162 fixedly attached to the base 14 by a plurality of bar screws 163 for facilitating the axial alignment of the tube 10, the spline unit 6, and the motor unit 8. The motor 158 has an output shaft 164 connected to the spindle extension 146 of the spindle shaft 128 by a spindle coupling 166. Additional setscrews 147, or coupling pins 122 can secure the spindle coupling 166 to the output shaft 164 and/or the spindle extension 146. Thus rotation of the output shaft 164 of the motor 158 produces corresponding rotation of the spindle shaft 128, the spline shaft 124, and the tapered mandrel 120.

Preferably the motor 158 is capable of variable speed drive under external control for controlling the speed of swaging, and reversible for withdrawing the tapered mandrel once swaging is complete. Thus the tapered mandrel 120 can be driven by the motor 158 at a first high speed producing rapid initial swaging for high production efficiency, followed by a second low speed producing slow final swaging for preventing springback of the tube 10 following completion of the swage. The second slow speed provides a further advantage in that swaging can be more uniformly terminated when high speeds of rotation are not involved.

Preferably the motor 158 has a plurality of windings for producing a rotating magnetic field when driven by corresponding phases of a variable frequency oscillator, for convenient operation of the motor at a speed proportional to the oscillator frequency.

Preferably the motor 156 is equipped with a torque transducer 168 for measuring the torque required to turn the mandrel during swaging for controlling the amount of swaging. The torque transducer 168 can employ a strain gage applied to the output shaft 164 and externally connected by means of slip-rings and corresponding brushes (not shown).

Preferably the motor 158 includes reduction gearing for matching motor characteristics with speed and torque drives requirements of the tapered mandrel 120. Preferably the torque transducer 168 is configured with a static element sensing reaction forces associated with the reduction gearing for permitting electrical connection to the sensing element without requiring slip-rings and brushes.

Operation

In operation, the tube 10 and the sleeve 11 are loaded into the vise unit 2. Pressure is applied to the clamp actuator 36 by the first solenoid valve 60, clamping the die set closed around the tube 10 and the sleeve 11 as described above. At this point an automatic swaging cycle can be initiated, the machine elements being first positioned as shown in FIG. 1. The tool unit 4 is in position a, holding the expander tool 5 in a retracted position. The spline yoke 136 is in position b, holding the tapered mandrel 120 in a withdrawn position. In the automatic swaging cycle, the motor 158 is energized, beginning forward rotation of the tapered mandrel 120. The second solenoid valve 108 is also energized, applying hydraulic pressure to the tool cylinder block 104, thereby advancing the tool unit 2 to position c in FIG. 2. The movement of the tool unit 2 from position a to position c positions the nose portion 114 of the expander tool 5 within the tube 10. At the same time, the tapered mandrel 120 is carried along with the expander tool 5, causing the spline shaft 124 to be extended from the spindle shaft 128 until the spindle yoke 136 is at position d in FIG. 2.

Preferably a tare torque measurement of the drive torque required to turn the tapered mandrel 120, prior to swaging, can be measured, once the motor 158 has reached a stable speed. This measurement, corresponding to rotational drag on the output shaft 164, the spindle shaft 128, the spline shaft 124 and the tapered mandrel 120, permits subsequent drive torque measurements to be compensated by the tare torque for changing drag conditions due to bearing wear and the like during the life of the machine for uniformly controlling the amount of swaging. Preferably a new tare torque is measured in each swaging cycle for correcting cycle-to-cycle variations in the rotational drag. Preferably the measurement of tare torque is done with the tapered mandrel 120 rotating at the second low speed so that dynamic components of the tare torque will correspond to dynamic components of drag during final swaging. Following measurement of the tare torque, the tapered mandrel 120 can be driven at the first high speed for rapid initial swaging.

Figure 2:
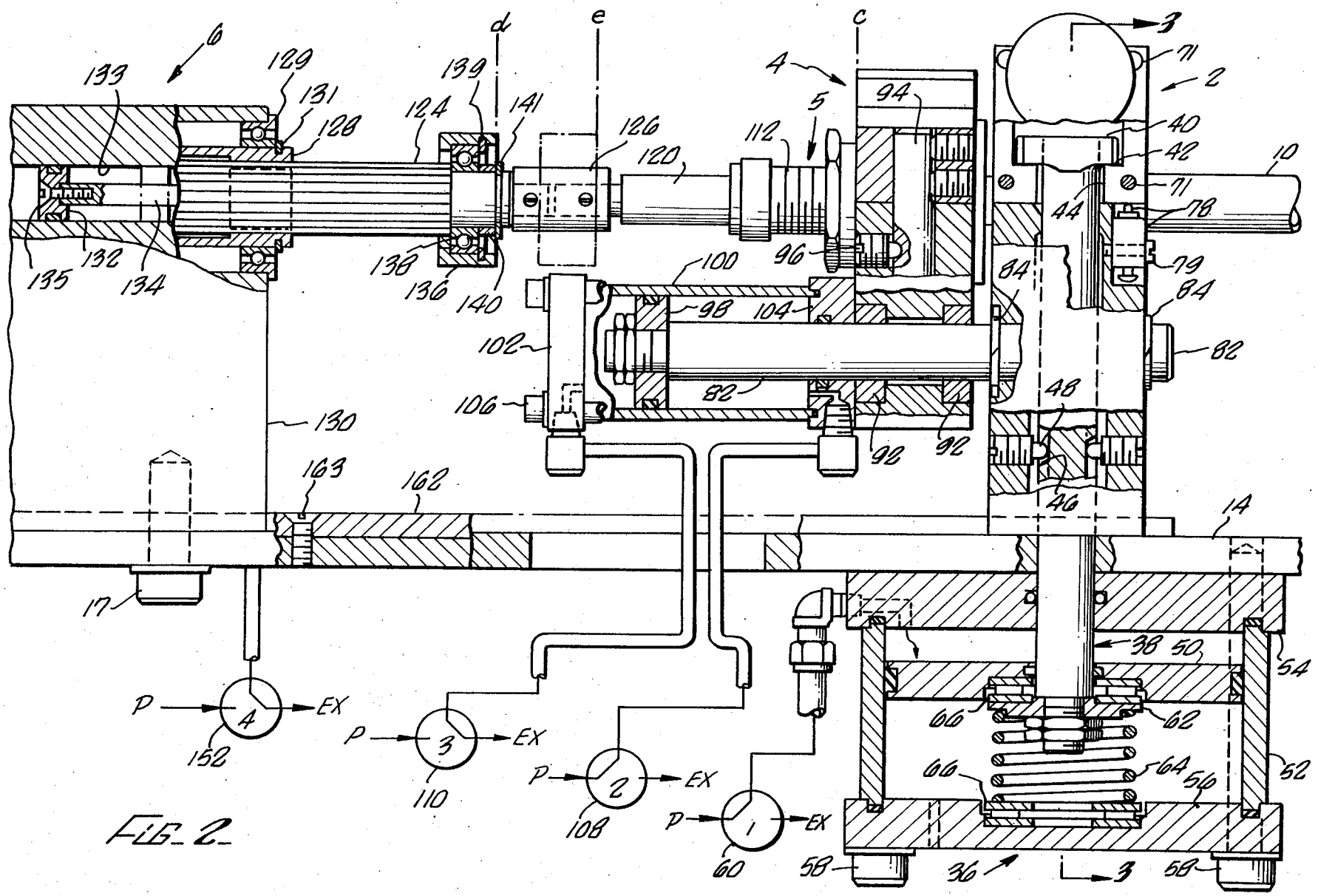
FIG. 2 is an enlarged fragmentary sectional elevational view of the machine of FIG. 1, the expander assembly shown in an engaged position.
Figure 4:
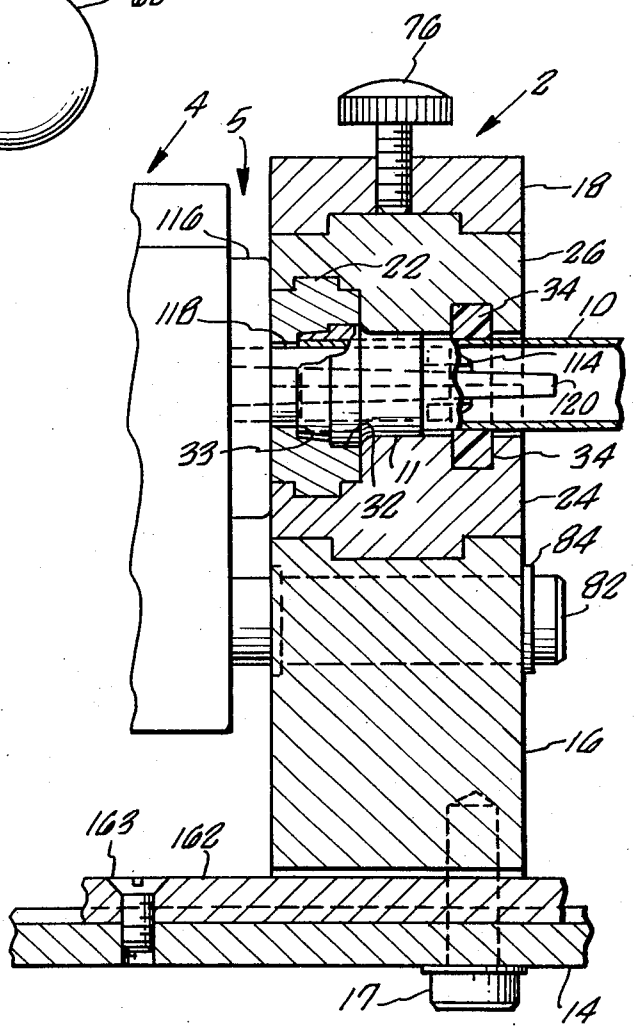
FIG. 4 is a fragmentary sectional elevational view of the machine of FIG. 1 taken along line 4—4 in Fig. 3.
Figure 3:
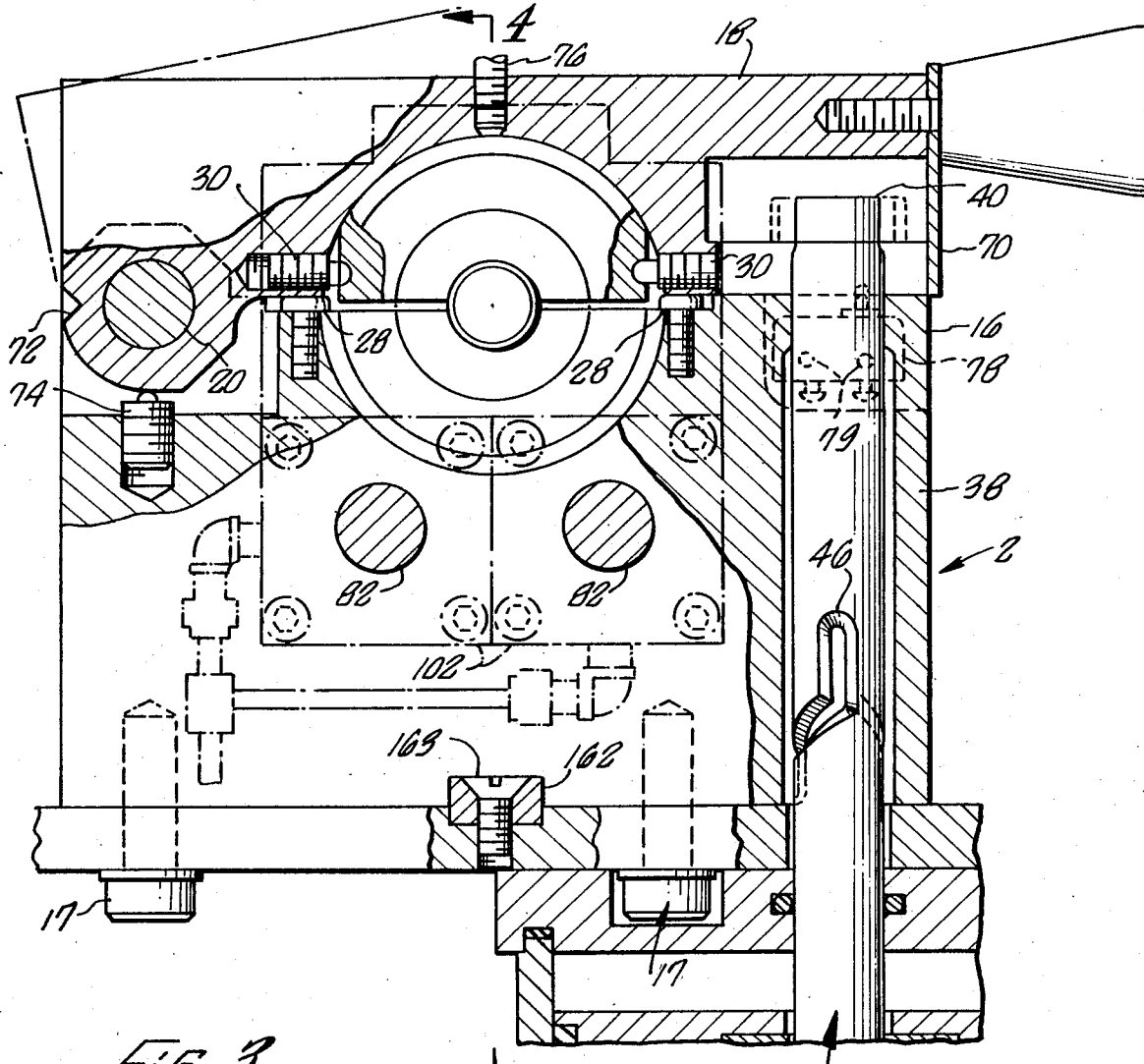
FIG. 3 is a fragmentary sectional elevational view of the machine of FIG. 1 taken along line 3—3 in Fig. 2.

Following measurment of the tare torque the fifth solenoid valve 138 is energized, directing hydraulic pressure inside the spindle cylinders 133 between the cylinder flange 144 and the spindle piston 132, moving the spline yoke 136 to position e in FIG. 2, thereby advancing the tapered mandrel 120 into engagement with the tapered rollers 118. Upon engagement of the tapered mandrel 120 with the tapered rollers 118, continued rotation of the tapered mandrel 120 by the motor 158 causes the torque sensed by the torque transducer 168 to increase to a threshold value associated with engagement of the tapered mandrel 120, and causes further advancement of the tapered mandrel 120 and corresponding enlargement of the inside diameter of the tube 10 as it is swaged by the tapered rollers 118. As the swaging of the tube 10 progresses, the torque sensed by the torque transducer 168 progressively increases toward a final value corresponding to completion of swaging. When the torque sensed by the torque transducer 168 reaches a predetermined intermediate level corresponding to partial completion of swaging, the speed of the motor 158 is reduced for slowing down the rate of swaging to avoid springback of the tube 10 following completion of the swage. For example, when swaging to a final torque value of 120 in-lb., the motor 158, and the tapered mandrel 120, can be slowed from a first high speed of 340 RPM to 120 RPM, the first high speed continuing until the drive torque reaches 50 in-lb.

It should be understood that the manner of slowing the motor 158 can be relatively sudden or gradual, within the scope of the present invention, as long as there is high speed swaging for a substantial portion of the swaging, and a subsequent significant amount of low-speed swaging at no more than half the high speed until swaging is complete. In the above example, the speed can be reduced to 120 RPM before the torque reaches 96 in-lb., 80% of the final torque value.

As the motor output shaft 164 continues to rotate at the slow speed, the torque sensed by the torque transducer 168 continues to increase. When the torque reaches a predetermined final value, swaging is halted rapidly by reversing power to the motor 158 for preventing further increased torque, and for disengaging the expander tool 5.

The intermediate torque level triggering the second slow speed is a significant proportion, at least 40% of the final value for substantially decreasing the time required for swaging below the time required to swage at the slow speed only. Preferably the intermediate torque level is at least 80% of the final value for further decreasing the time required for swaging.

It should be understood that the high and low speeds of rotation of the mandrel 120 can be implemented in an alternative system including means for measuring axial advance of the tapered mandrel 120, wherein the second slow speed is triggered by a predetermined advance of the tapered mandrel 120.

In order to prevent springback of the tube 10, the mandrel should be driven at no more than half of the first high speed while the torque is more than 90% of the final value.

As an indication of the time savings achieved with the present invention, based on a final torque value of 120 in-lb., an intermediate level of 80% of the final value, an initial engaged torque of 10% of the final value, and sudden slowing to a second slow speed of 50% of the first high speed, the torque increase can be approximated by a logarithmic time relationship inversely proportional to the swaging speed. For example, if the time required for the entire swage to be completed at the low speed is proportional to $ln(120)-ln\ (12)=2.303$, the time required for swaging according to the present invention is proportional to $(2.303)-((ln\ (0.8\times120-ln\ (12))/2)=2.303-1.040=1.263$. This represents less than 55% of the time required for the entire swage to be completed at the low speed, representing a dramatic improvement in productivity over single-speed swaging of the prior art, resulting in a substantial cost savings.

When the swaging is halted, the fifth solenoid valve 154 has been deenergized and the fourth solenoid valve is energized, biasing the spline yoke 136 toward position b in FIG. 1. The second solenoid valve 108 is also deenergized, biasing the tool unit 4 away from the vice unit 12. Once the tapered mandrel 120 has rotated sufficiently in the reverse direction, the tool unit 4 and the spline yoke 136 return to positions a and b respectively in FIG. 1. The first solenoid valve 60 is next released, the dog 40 lifting and rotating from engagement with the dog seat 42 so that the upper die shell can be raised to an open position by the operator. The completed assembly of the tube 10 and the sleeve 11 can then be removed from the vise unit 2 and a new swaging cycle can be initiated.

Computer System 9

Figures 6, 8:
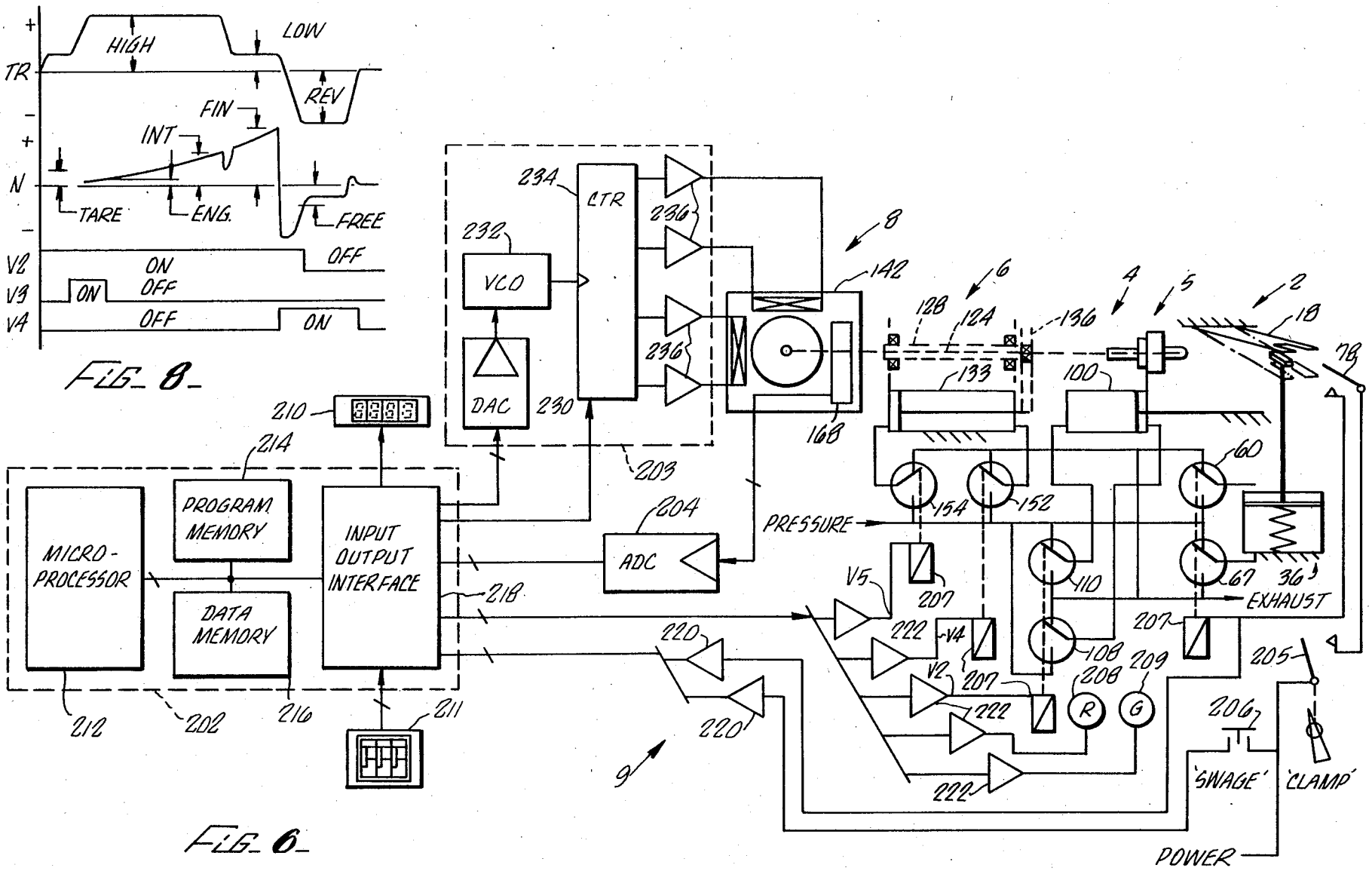
FIG. 6 is a block diagram of the machine of FIG. 1, including a computer system for automatically controlling a swaging cycle.
FIG. 8 is a timing diagram of the swaging cycle provided by the computer system of FIG. 6, according to the computer program of FIG. 7.

With reference to FIG. 6, the above-described automatic swaging cycle can be provided by connecting the solenoid valves 60, 67, 108, 110, 152, 154, the motor 158, the torque transducer 168, and the interlock switch 78 in a computer system 9. The computer system 9 includes a micro computer 202, a motor speed control 203, an analog to digital converter 204 for the torque transducer 168, a clamp switch 205, a swage switch 206, a plurality of solenoid actuators 207 for the solenoid valves, a red indicator lamp 208, a green indicator lamp 209, a display unit 210, and a thumbwheel switch unit 211.

The micro computer 202 includes a micro processor 212, a program memory 214, a data memory 216, and an input-output interface 218. The micro computer 202 includes a program interrupt capability having associated clock circuity for regularly interrupting one program sequence to perform another sequence.

The input-output interface 218, controlled by the micro processor 212 and the program memory 214, receives status signals from the interlock switch 78 and the swage switch 206, buffered by corresponding receivers 220, torque signals from the analog to digital converter 204, and parameter signals from the thumbwheel switch unit 211. The input-output interface 218 also sends speed and direction signals to the motor speed control 203, information signals to the display unit 210 and, buffered by corresponding drivers 222, drive signals to the solenoid valves 108, (110,) 152, 154, the red indicator lamp 208, and the green indicator lamp 209. The computer system 9 described herein is representative of several similar computer systems, any of which may be used to practice this invention. In a typical computer system, program steps and data are processed as eight-bit bytes, with program and data memory of up to 64,000 bytes being directly addressable.

The motor speed control control 203, operating in combination with the micro computer 202, drives the motor 158 bidirectionally to predetermined speeds for rotating the tapered mandrel in an automatic swaging cycle according to the present invention. The micro computer 202 generates appropriate set points of motor speed and direction signals for accelerating the motor rapidly to the corresponding set points. The motor speed converter 230 for receiving the rate signals from the input-output interface of the micro computer 202. The digital to analog converter 230 drives a voltage controlled oscillator 232 over a corresponding frequency range. A reversible switch-tailed ring counter 234, having a plurality of stages corresponding to the windings of the motor 158, is driven by the voltage controlled oscillator 232 to produce signals appropriately shifted in phase for driving the motor. Each stage of the ring counter 234 produces a pair of complementary counter signals, each signal connected through a drive amplifier 236 to a corresponding end of an associated winding of the motor 158. The direction signal produced by the micro computer 202, connected between the input-output interface 218 and the ring counter 234, determines the direction of counting of the ring counter 234 for controlling forward and reverse operation of the motor 158.

The motor 158 can have two windings phased at 90 degrees, as shown in the drawings. Correspondingly, the ring counter 232 has two stages connected to a total of four of the drive amplifiers 236. Four cycles of the voltage controlled oscellator are required to produce one cycle of magnetic rotation by the windings of the motor 158.

In an alternative version, not shown, the motor 158 has three windings phased at 60 degrees, the ring counter 234 has three stages, and there are six of drive amplifiers 236. In this version, six cycles of the voltage controlled oscillator 232 are required to produce one cycle of magnetic rotation by the windings of the motor 158. This version, although more complex, advantageously makes use of a three-phase motor for greater motor availability and lower cost in appropriate power ratings than the two-phase version.

Preferably the voltage controlled oscillator 232 is prevented from oscillating when the rate signal corresponds to a set point of zero motor speed for conveniently stopping the motor. As the rate signal increases, the motor synchronously accelerates with the cycles of the ring counter 234 as it is driven by the voltage controlled oscillator 232.

The clamp switch 205, actuated by the operator, connects electrical power to the interlock switch 78 for operation of the first solenoid valve 60 (and the auxiliary solenoid valve 67) by the corresponding solenoid actuator 207 to clamp the vise unit 2 closed. Unless the movable jaw 18 of the vise unit 2 is first closed, the interlock switch 78 prevents power from reaching the solenoid actuator 207. When the first solenoid valve 60 is operated, the power to the corresponding solenoid actuator 207 is sensed by the associated receiver 220 for input to the micro computer 202. Subsequent operation of the swage switch 206, sensed by the associated receiver 220 and input to the micro computer 202, can initiate the automatic swaging cycle.

The red indicator lamp 208 can be controlled by the micro computer 202 for indicating that a swaging cycle is in operation. The green indicator lamp 209 can be controlled by the micro computer 202 for indicating that the vise unit 2 is clamped prior to, and following completion of a swaging cycle. When the green lamp 209 is on, the operater can properly initiate a swaging cycle or release the clamped condition of the vise unit 2. Preferably a new swaging cycle is inhibited until the vise unit 2 is first unclamped as described below.

Figure 7:
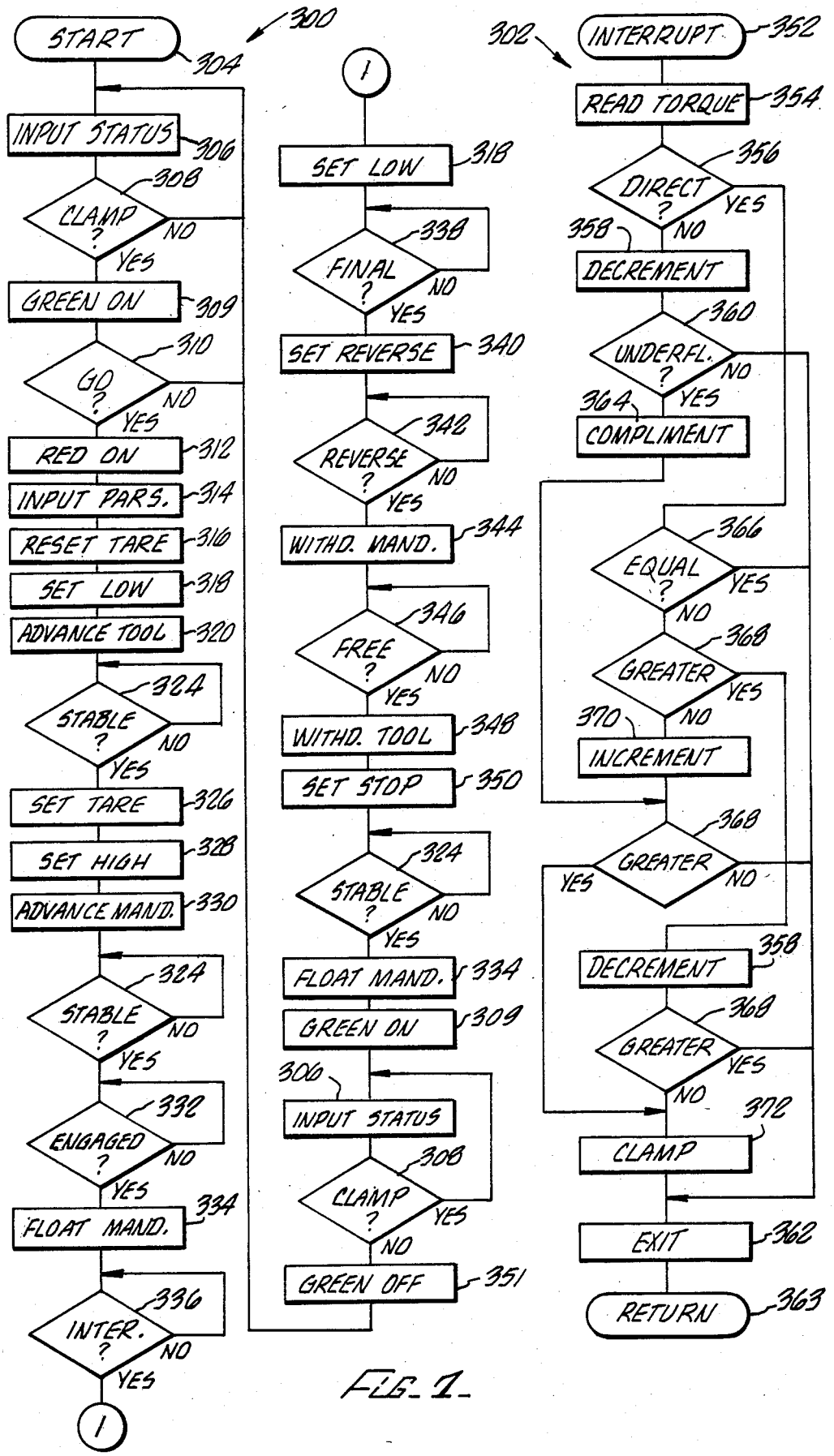
FIG. 7, is a flow chart for a computer program controlling the computer system of FIG. 6.

With reference to FIGS. 7 and 8, the computer system 9 can be programmed according to this invention to perform a sequence of steps, controlling the automatic swaging cycle. The sequence of steps comprises a main program 300 for controlling the automatic swaging cycle, including the motor speed and direction set points, and an interrupt program 302 for generating the smoothly varying rate and direction signals used by the motor speed control 203, and for sequencing the analog to digital connecter 204.

In the main program 300, a start condition 304 is reached following conventional initialization. An input status step 306 next reads and temporarily stores computer data representing the condition of the interlock switch 78 and the swage switch 206. A clamp conditional branch step 308 tests the status data to determining whether the vise unit 2 has been clamped. If so, a green on step 309 causes the green indicator lamp 209 to become illuminated, and, for later convenience, insures that the red indicator lamp 208 is extinguished. Next, a go conditional branch step 310 tests the status data for determining whether the swage switch 206 is being actuated. If so, a swaging cycle is initiated as described below; if not, or if the vise unit 2 had not been clamped, the input status step 306 is repeated as described above. In this manner, the computer system 9 waits until the swage switch 206 is operated while the vise unit 2 is clamped, then initiates a swaging cycle.

Upon initiating a swaging cycle a red on step 312 extinguishes the green indicator lamp 209 and illuminates the red indicator lamp 208 for indicating that a swaging cycle is in process. An input parameters step 314 next causes the input output interface 218 to interrogate the thumbwheel switch unit 211 to read swaging data identification previously set by the operator. The swaging data for a particular combination of the tube 10 and the sleeve 11 to be swaged can be identified by an arbitrary index term assigned to each of the combinations.

Alternatively, the swaging data can be indentified by a characteristic variable included in the data, such as the final swaging torque. The input parameters step 314 causes temporary storage of a pointer to a location in memory containing the identified swaging data.

The swaging data includes the the final swaging torque for each of the combinations of the tube 10 and the sleve 11. Preferably the swaging data also includes the first high speed and the second low speed of the tapered mandrel 120, a threshold torque level for determining engagement of the tapered mandrel, and the intermediate torque level initiating the second low speed of the mandrels.

Alternatively some of the swaging data can be computed as being functionally related to the final swaging torque.

Following the input parameters step 314, a reset tare step 316 temporarily stores a zero value representing tare torque preparatory to measurement of the tare torque. As described in more detail below, the interrupt program 302 periodically causes input of measured torque values from the analog to digital converter 204, subtracting the tare torque to provide temporary storage of compensated torque measurements N.

A set low step 318 next causes temporary storage of low speed and forward direction set point data SETR and SETD for the motor 158 corresponding to the second low speed of the swaging cycle. As described in more detail below, the interrupt program 302 causes smooth, rapid acceleration of the motor 158 to the speed and direction corresponding to the set point data SETR and SETD, simultaneously providing periodic temporary storage of transiend direction corresponding to the set point data SETR and SETD, simultaneously providing periodic temporary storage of transient motor speed TR and direction TD.

After the set low step 318, an advance tool step 320 causes the second solenoid valve to be energised, advancing the expander tool 5 into the tube 10, followed by a stable conditional branch step 324 for testing whether TR and TD have reached equality with SETR and SETD. If not, the stable conditional branch step 324 is repeated until the motor 158 reaches the second low speed.

Once the motor has stabilized at the second slow speed, a set tare step 326 causes the currently stored torque value N to be used as tare torque for subsequent torque measurements. Following tare torque measurement, a set high step 328 causes temporary storage of set point data SETR and SETD for the first high speed of the motor 158. An advance mandrel step 330 next causes the fifth solenoid valve 154 to be energised, biasing the tapered rollers 118 of the expander tool 5.

Preparatory to determining engagement of the tapered mandrel 120, the stable conditional branch step 324 is repeated until the motor has reached the first high speed for ignoring transient torque measurements associated with acceleration of the motor 158. A step can be repeated at more than one point in a sequence of steps by calling the step as a subroutine, as is well known in the art.

An engaged conditional branch step 332 next tests whether N exceeds the threshold torque associated with engagement of the tapered mandrel 120, establishing a beginning of swaging. If not, the engaged conditional branch step 332 is repeated until engagement is verified. Once the tapered mandrel 120 is engaged, a float step 334 causes the fifth solenoid valve 154 to be deenergized, minimizing axial forces on the tapered mandrel 120 as it continues to advance into the expander tool 10, swaging the tube 10 into the sleeve 11. For convenience, the float step 334 also provides for deenergizing the fourth solenoid valve 152 at the end of the swaging cycle, discussed below.

Swaging having commenced, an intermediate conditional branch step 336, testing whether N has reached the intermediate torque level for triggering the second slow speed, is repeated until successful, followed by the set low step 318 for slowing swaging to the second slow speed.

While swaging progresses at the second slow speed, a final conditional branch step 338, testing whether N has reached the final torque level signifying completion of the swage, is repeated until successful, followed by a set reverse step 340 causing the set point data for the motor 158 to be changed to high speed in reverse for quickly terminating the swaging.

While the motor 158 is accelerating in a reverse direction, a reverse conditional branch step 342, testing whether the transient motor direction TD has reversed, is repeated until successful, followed by a withdraw mandrel step 344, causing the fourth solenoid valve 152 to be energised for biasing the tapered mandrel 120 away from engagement with the tapered rollers 118 of the expander tool 5.

Once the motor 158 begins to rotate the tapered mandrel 120 in reverse, a free conditional branch step 346 tests whether N, after reaching a transient negative level, has decreased positively below a reverse threshold value for indicating disengagement of the tapered mandrel 120. A withdraw tool step 348 next causes the second solenoid valve 108 to become deenergised, moving the expander tool 5 to position a in FIG. 1.

Following disengagement of the tapered mandrel 120, a set stop step 350 stores set point data for stopping the motor 158. The stable conditional branch step 324, testing whether the motor has come to rest, is repeated until successful, followed by the float step 334 for deenergizing the fourth solenoid valve 152. The green on step 309 next extinguishes the red indicator lamp 208 and illuminates the green indicator lamp 209 for indicating that the automatic swaging cycle is complete and that the vise unit 2 can be unclamped by the operator.

Finally, the input status step 306, followed by the clamp conditional branch step 308 is repeated until the vise unit 2 is no longer clamped for insuring that a new swaging cycle is not initiated unless the vise unit 2 has first been reloaded. A green off step 351 extinguishes the green indicator lamp 209 for indicating that the vise unit 2 may be opened for reloading, followed by a return to the start condition 304.

In the interrupt program 302, the main program 300 is suspended at regular intervals as described above, producing an interrupt condition 352. A read torque step 354, providing timing and control of the analog to digital converter 204 by methods known to those skilled in the art, reads transient torque data corresponding to signals produced by the torque transducer 168. The temporarily stored tare torque is subtrated from the transient data and the resulting compensated value is temporarily stored as the measured torque N for use by the main program 300.

The smooth, rapid acceleration of the motor 158 is provided by first performing a direction conditional branch step 356 for testing whether the transient motor direction data, TD, previously sent to the motor controller 203 corresponds to the set point direction data, SETD. If not, the transient motor rate data, TR, previously sent to the motor controller 203 is decremented in a decrement step 358 by an amount corresponding to rapid deceleration within the capability of the motor 158, followed by an underflow conditional branch step 360 testing whether TR was decremented below zero by the decrement step 358. If not, an exit step 362 sends the current transient motor speed and direction data, TD and TR, to the motor speed control 203, followed by a return step 363 to the main program 300, ending the interrupt program 302 until the interrupt condition 304 is repeated.

Preferably the exit step 362 saves previous values of TD and TR for use by the main program 300, preventing the current values from being accessed for such use until at least one interrupt condition 352 has intervened. In this manner, premature use of TD and TR by the main program 300 is prevented.

If TR was decremented below zero, a complement step 364 converts TR to a corresponding positive value and changes TD to agree with the set point direction for further processing described below.

If the direction conditional branch step 356 found that TD corresponding to the set point direction, an equal conditional branch step 366 tests whether TR corresponds to the set point rate, SETR. If so, the exit step 362 is performed as described above. If not, a greater conditional branch step 368 tests whether TR is greater than SETR. If not, an increment step 370 increments TR by an amount corresponding to rapid acceleration within the capability of the motor 158.

Next, and also following the complement step 364 decribed above, the greater conditional branch step 368 tests whether TR is greater than SETR. If not, the exit step 362 is performed as described above. If TR was found greater than SETR, a clamp step 372 conforms TR with SETR causing acceleration or deceleration of the motor 168 to be terminated, followed by the exit step 362 as described above.

If the greater conditional branch step 368 following the equal conditional branch step 366 had found TR greater than SETR, the decrement step 358 reduces TR as described above, followed by the greater conditional branch step 368 for determining whether TR is still greater than SETR. If so, the exit step 362 is performed as described above, otherwise the clamp step 372 and the exit step 362 are performed as described above.

If desired, in order to more slowly decelerate the motor 158 from the first high speed than when reversing the motor for terminating the swaging, a smaller decrement for TR can be provided in the decrement step 358 following the direction step 356. The interrupt program 302 can also perform other functions known to those skilled in the art, such as monitoring possible fault conditions and/or operator intervention of the swaging cycle.

Although the present invention has been described in considerable detail with regard to certain versions thereof, other versions are possible. For example, functional equivalents to the digital to analog converter 230, the voltage controlled oscillator 232, and the ring counter 234 can be provided by suitable programming of the micro computer 202. Conversely, the smoothly varying rate signals produced by the micro computer can be generated by analog filtering of the motor speed set points within the motor speed control 203. Further, when the material of the tube 10 is not subject to springback, the slow speed of rotation of the tapered mandrel 120 can be dispensed with for higher production rates. Therefore, the spirit and scope of the appended claims should not necessarily be limited to the description of the versions contained herein.

What is claimed is:

1. A roller swaging machine for installing a metallic sleeve on a metallic tube by expanding the tube into engagement with the sleeve, the machine comprising:

(a) an expander assembly having a tapered mandrel for engaging a plurality of tapered rollers for expanding the tube as the mandrel is rotated and advanced on its axis, the mandrel requiring a final maximum torque as the tube reaches complete expansion; and (b) a drive for rotating the mandrel in a swaging cycle, the drive being capable of rotating the mandrel at a high speed and at low speeds; and (c) control means for the drive for (i) rotating the mandrel at the high speed during initial expansion of the tube and (ii) during final expansion of the tube when rotation of the mandrel requires more than 90 percent of the final maximum torque, rotating the mandrel at speeds no more than 50 percent of the high speed.

2. The machine of claim 1 including means for sensing the torque required to rotate the mandrel during swaging, wherein swaging is terminated at a predetermined final torque level.

3. The machine of claim 2 wherein the means for sensing the torque comprises: means for measuring an initial torque level required to rotate the mandrel before the tube begins to expand; and means for compensating measured torque levels during swaging by an amount corresponding to the initial torque level.

4. The machine of claim 3 wherein the initial torque level is measured in each swaging cycle.

5. The machine of claim 2 wherein the first high speed of the mandrel is terminated when the torque required to turn the mandrel reaches a predetermined intermediate level, the intermediate level being at least 40 percent of the final torque level.

6. The machine of claim 5 wherein the intermediate level of the torque required to turn the mandrel is at least about 80 percent of the final torque level.

7. The machine of claim 5 wherein the swaging cycle includes means for automatically inserting the expander assembly into the tube, advancing the mandrel into engagement with the rollers and, following the final expansion of the tube, reversing rotation of the mandrel for releasing the expander assembly, and retracting the mandrel and the expander assembly from the tube.

8. In a method for installing a metallic fitting on a metallic tube by roller-swaging where a tapered mandrel is rotated and fed into the tube to expand the tube into engagement with the fitting, wherein the mandrel requires a final torque as the tube reaches complete expansion, the improvement comprising:

(a) during a first period of time, during which time the torque on the mandrel reaches at least 40 percent of the final torque, rotating the mandrel at a high first speed for rapidly expanding the tube into engagement with the fitting;

(b) during a second period of time, reducing the speed of the mandrel to a lower second speed, the second speed being no more than 50 percent of the first speed, the second speed not being exceeded once the mandrel requires at least 90 percent of the final torque; and (c) rotating the mandrel at the second speed until swaging is complete.

9. The method of claim 8 wherein the step of rotating the mandrel at the first speed is continued until the mandrel advances a predetermined distance into the tube.

10. In a method for installing a metallic fitting on a metallic tube by roller-swaging where a tapered mandrel is rotated and fed into the tube to expand the tube into engagement with the fitting, the rotation continuing until the torque on the mandrel reaches a final preselected value, the improvement comprising:

(a) during a first period of time, during which time the torque on the mandrel reaches at least 40 percent of the final preselected value, rotating the mandrel at a first high speed for rapidly expanding the tube into engagement with the fitting;

(b) during a second period of time, reducing the speed of the mandrel to a lower second speed, the lower second speed being no more than 50 percent of the first speed, the second speed not being exceeded once the torque on the mandrel reaches 90 percent of the final preselected value; and (c) rotating the mandrel at the second speed until the torque reaches the final preselected value.

11. The method of claim 10 wherein the step of rotating the mandrel at the first high speed is continued until the torque on the mandrel reaches at least about 80 percent of the final preselected value.

12. A roller swaging machine for installing a metallic sleeve on a metallic tube by expanding the tube into engagement with the sleeve, the machine comprising:

(a) an expander assembly having a tapered mandrel for engaging a plurality of tapered rollers for expanding the tube as the mandrel is rotated and advanced on its axis, the mandrel requiring a final maximum torque as the tube reaches complete expansion;

(b) a drive for rotating the mandrel in a swaging cycle;

(c) means for automatically inserting the expander assembly into the tube, advancing the mandrel into engagement with the rollers and, following the final expansion of the tube, reversing rotation of the mandrwl for releasing the expander assembly and retracting the mandrel and the expander assembly from the tube; and (d) means for sensing the torque required to rotate the mandrel during swaging, wherein swaging is terminated at a predetermined final torque level, the means for sensing the torque further comprising:

(i) means for measuring an inital torque level required to rotate the mandrel before the tube begins to expand; and (ii) means for compensating measured torque levels during swaging by an amount corresponding to the initial torque level.

13. The machine of claim 12 wherein the initial torque level is measured in each swaging cycle.

* * * * *